US009423078B2

(12) United States Patent
Liang et al.

(10) Patent No.: US 9,423,078 B2
(45) Date of Patent: Aug. 23, 2016

(54) LED LAMP

(71) Applicant: HON HAI PRECISION INDUSTRY CO., LTD., New Taipei (TW)

(72) Inventors: Chun-Wei Liang, New Taipei (TW); Kuang-Ming Hsiao, New Taipei (TW); Chun-Si Chou, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 67 days.

(21) Appl. No.: 14/519,928

(22) Filed: Oct. 21, 2014

(65) Prior Publication Data

US 2015/0292727 A1 Oct. 15, 2015

(30) Foreign Application Priority Data

Apr. 15, 2014 (CN) ..... 2014 1 0149873

(51) Int. Cl.

| | |
|---|---|
| ***F21V 21/00*** | (2006.01) |
| ***F21K 99/00*** | (2016.01) |
| ***F21V 29/83*** | (2015.01) |
| *F21Y 101/02* | (2006.01) |
| *F21Y 103/025* | (2006.01) |
| *F21V 3/02* | (2006.01) |
| *F21Y 111/00* | (2016.01) |
| *F21V 29/77* | (2015.01) |

(52) U.S. Cl.

CPC ..... *F21K 9/135* (2013.01); *F21V 29/83* (2015.01); *F21V 3/02* (2013.01); *F21V 29/773* (2015.01); *F21Y 2101/02* (2013.01); *F21Y 2103/025* (2013.01); *F21Y 2111/001* (2013.01)

(58) Field of Classification Search

CPC ..... F21K 9/135

See application file for complete search history.

(56) References Cited

U.S. PATENT DOCUMENTS

2013/0293084 A1* 11/2013 Lim ..... H05B 33/02 313/46

* cited by examiner

*Primary Examiner* — Sean Gramling

(74) *Attorney, Agent, or Firm* — ScienBiziP, P.C.

(57) ABSTRACT

An LED lamp includes a light source, a lamp holder and a lamp body. The lamp body is connected between the light source and the lamp holder. The lamp body comprises a hollow main body, a plurality of fins, a cup, a tube and a plurality of ridges. The hollow main body is connected to the lamp holder. The fins are connected between the hollow main body and the cup. A plurality of channels are defined between the fins. A hole is defined in the cup, and the tube is connected to the hole of the cup. The ridges are formed on the cup and around the tube. The light source is formed on the ridges. The light source comprises a plurality of LED elements and a plurality of circuit printed boards.

17 Claims, 5 Drawing Sheets

LED LAMP

CROSS-REFERENCE TO RELATED APPLICATIONS

This application claims priority to Chinese Patent Application No. 201410149873.9 filed on Apr. 15, 2014 in the State Intellectual Property Office Of The P. R. C, the contents of which are incorporated by reference herein.

FIELD

The disclosure relates to an LED (light emitting diode) lamp, and particularly to an LED lamp with high heat dissipation performance.

BACKGROUND

Heat generated from an LED lamp may cause a high temperature of the LED lamp, which has a bad effect for a performance and security of the LED lamp.

BRIEF DESCRIPTION OF THE DRAWINGS

Implementations of the present technology will now be described, by way of example only, with reference to the attached figures.

DETAILED DESCRIPTION

It will be appreciated that for simplicity and clarity of illustration, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Figure 1:
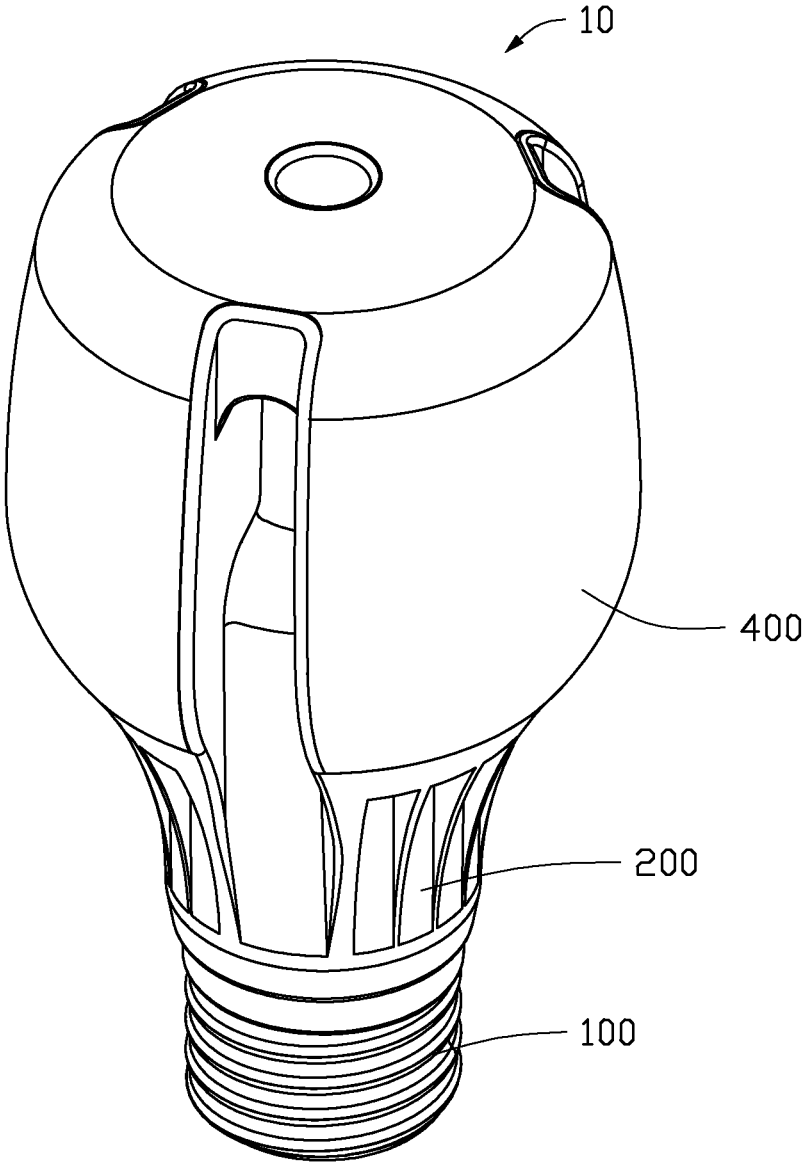
FIG. 1 is an isometric view showing an LED lamp in accordance with an exemplary embodiment of the present disclosure.
Figure 2:
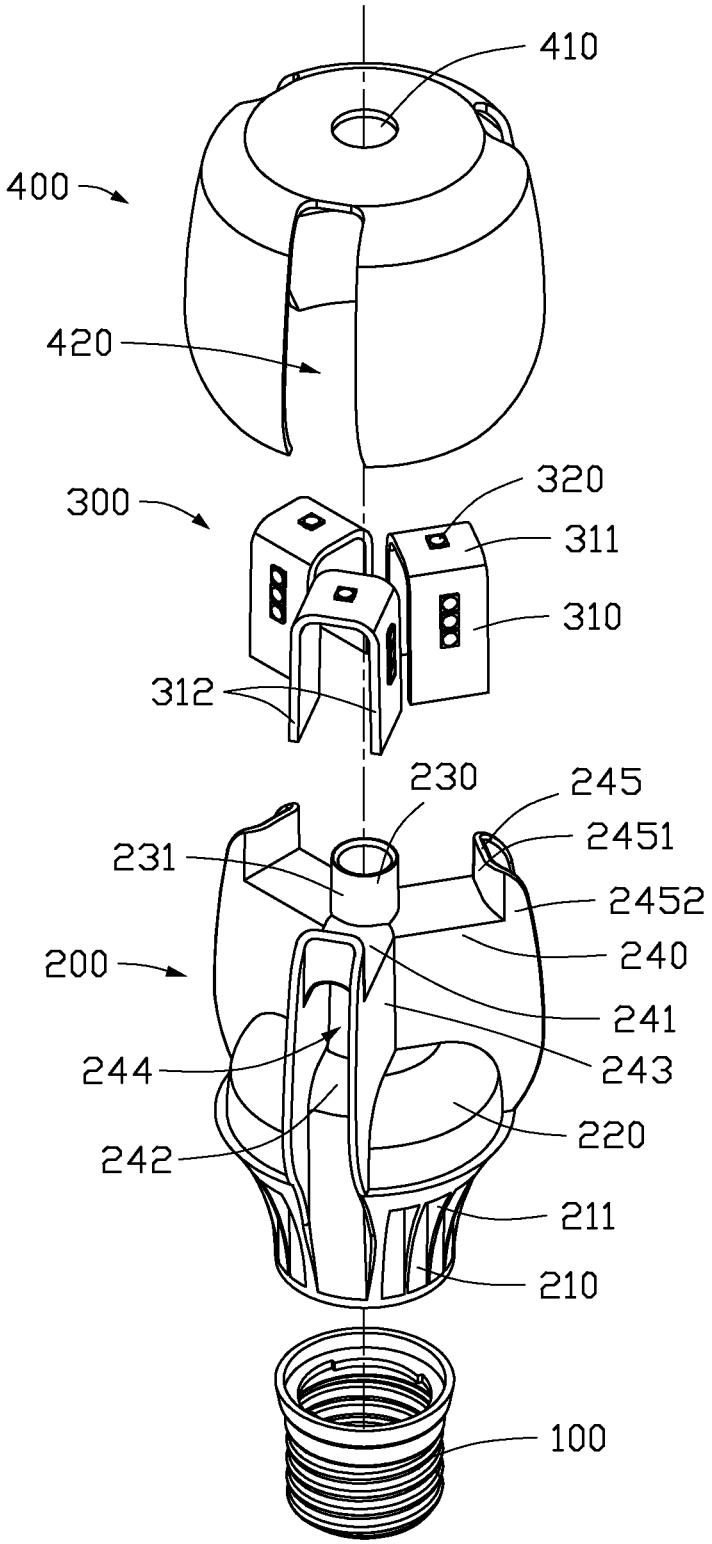
FIG. 2 is an exploded isometric view of FIG. 1.
Figure 3:
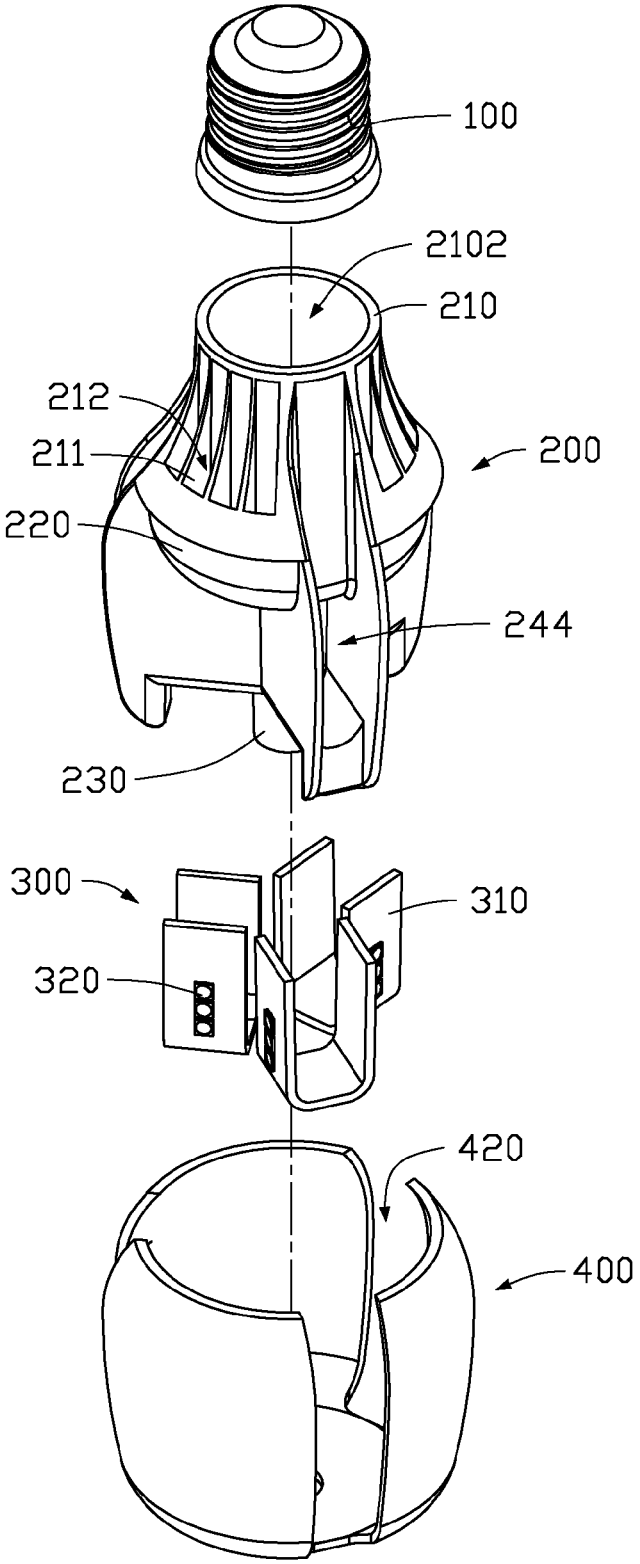
FIG. 3 is another view of FIG. 2.

Referring to FIGS. 1-3, an LED lamp 10 comprises a lamp holder 100, a lamp body 200, and a light source 300. The lamp body 200 is connected between the lamp holder 100 and the light source 300. In at least one embodiment, the lamp holder 100, the lamp body 200 and the light source 300 can be arranged along bottom to top direction.

The lamp holder 100 can be a commonly-used lamp holder such as a standard screw cap. The lamp holder 100 is used for electrically connecting the LED lamp 10 to a power supply or power system.

Figure 4:
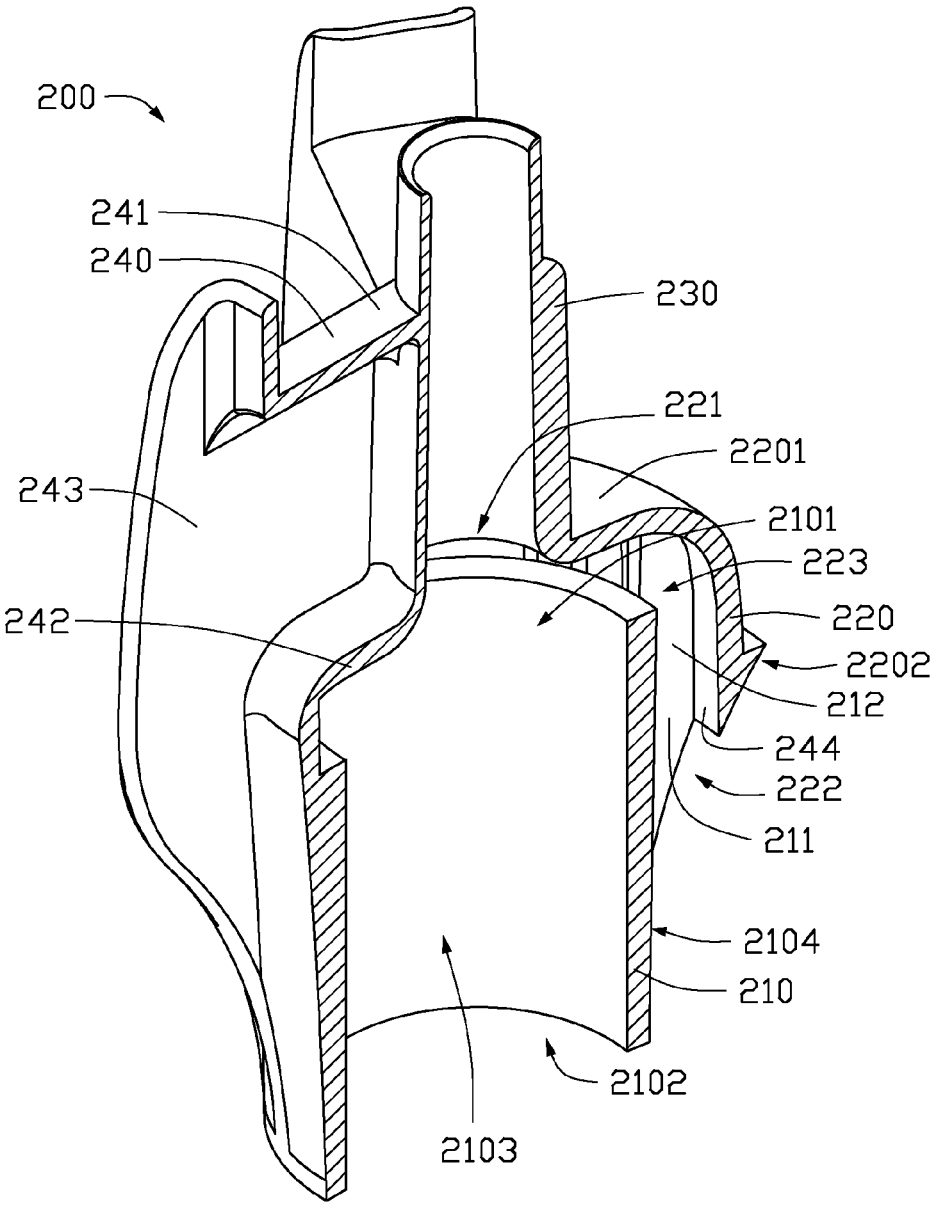
FIG. 4 is a part-sectional view showing one of elements in FIG. 2.

Referring to FIG. 4, the lamp body 200 can be made of aluminium alloy, magnesium alloy, zinc alloy, plastic, ceramic, or any other suitable material. The lamp body 200 can be made of heat conduction material. The lamp body 200 comprises a hollow main body 210, a cup 220, a tube 230 and a plurality of ridges 240.

The hollow main body 210 comprises a first opening 2101, a second opening 2102 and a chamber 2103. The first opening 2101 and the second opening 2102 are communicated to the chamber 2103. The first opening 2101 is defined at a top end of the hollow main body 210, and the second opening 2102 is defined at a bottom end of the hollow main body 210. The first opening 2101 faces the cup 220. The second opening 2102 is connected to the lamp holder 100. The chamber 2103 is used for receiving electronic components (not shown). In at least one embodiment, the hollow main body 210 is a hollow cylinder.

Figure 5:
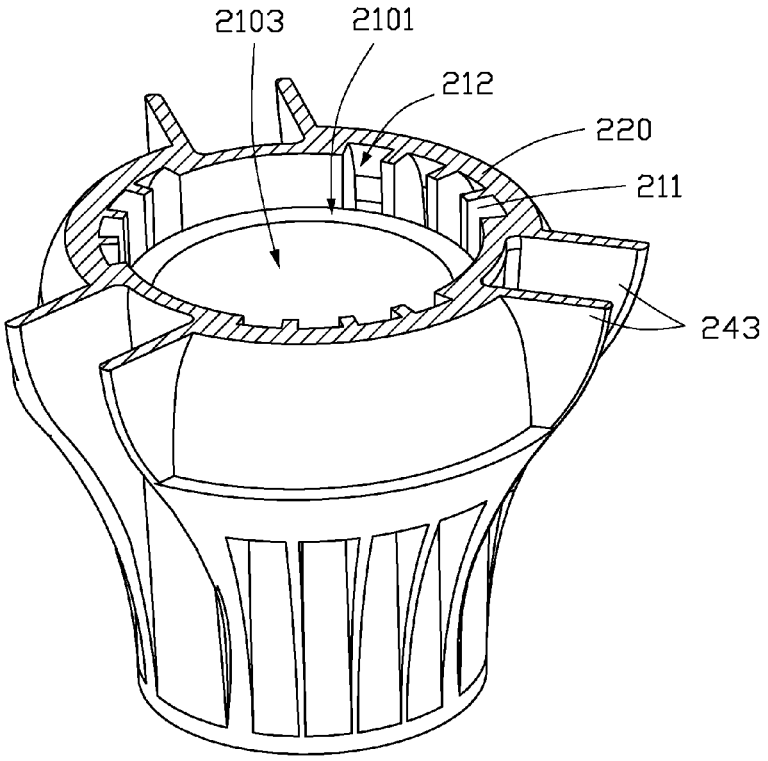
FIG. 5 is another part-sectional view showing the element in FIG. 4.

Referring to FIGS. 4 and 5, a plurality of fins 211 can be formed on a periphery 2104 of the hollow main body 210. A plurality of channels 212 can be defined between the fins 211. Each channel 212 is defined between two adjacent fins 211. The fins 211 can be formed in the vicinity of the first opening 2101 of the hollow main body 210.

The cup 220 comprises a first end 2201 and a second end 2202. A diameter of the second end 2202 is larger than that of the first end 2201. A hole 221 is defined on the first end 2201. The hole 221 is formed in the center of the first end 2201. An orifice 222 is defined in the second end 2202. A diameter of the orifice 222 is larger than that of the hole 221. The cup 220 covers the fins 211. The orifice 222 faces the hollow main body 210. The fins 221 are connected between an inside surface 224 of the cup 220 and the periphery 2104 of the hollow main body 210.

Each fin 211 is extended beyond the first opening 2101 of the hollow main body 210. A space 223 is defined between the cup 220 and the first opening 2101 of the hollow main body 210. The space 223 is connected between the chamber 2103, the channels 212 defined between the fins 211 and the hole 221 of the cup 220.

The tube 230 is connected to the hole 221 of the first end 2201 of the cup 220.

Air can flow between the chamber 2103 and outside environment through the tube 230, the hole 221 of the cup 220, the space 223 between the cup 220 and the hollow main body 210, and the channels 212 between the fins 211.

Referring to FIGS. 2, 4 and 5, the ridges 240 are formed on the cup 220 and around the tube 230. Each ridge 240 comprises a first wall 241, a second wall 242 and two third walls 243. The first wall 241 is opposite to the second wall 242. The first wall 241 is extended from the outside surface 231 of the tube 230. The second wall 243 can be a sunken area of the cup 220. The second wall 243 is sunken from the cup 220 to the hollow main body 210. The two third walls 243 are opposite to each other. The two third walls 243 are extended from the first wall 241 along the tube 230 to the second wall 242. The two third walls 243 are connected between the first wall 241 and the second wall 243. In at least one embodiment, the number of the ridges 240 is three. The three ridges 240 are extended from the outside surface 231 of the tube 230. An angle between each two adjacent ridges 240 is 120°. The first wall 241 and the two third walls 243 compose a U-shaped structure with a groove 244 defined away from the tube 230. Each groove 244 is surrounded and formed by the first wall 241, the second wall 242 and the two third walls 243. Air can flow between the grooves 244 and outside environment.

The light source 300 comprises a plurality of circuit printed boards 310 and a plurality of LED elements 320. The LED elements 320 are electrically connected to the circuit printed boards 310. The circuit printed boards 310 can be aluminum base circuit printed board, copper base circuit printed board, fiber-glass circuit printed board, multilayer circuit printed board or flexible circuit printed board et al. Each circuit printed board 310 comprises one first board 311 and two second boards 312. The two second boards 312 are opposite to each other. The first board 311 is formed on the first wall 241 of the ridge 240. The two second boards 312 are formed on the two third walls 243 respectively. In at least one embodiment, each circuit printed board 310 shows a U-shaped structure. The one first board 311 can be connected between the two second boards 312. Each circuit printed board 310 spans over and fittingly engages with one ridge 240.

The LED lamp of the present disclosure also comprises an envelope 400. The envelope 400 covers the light source 300. The envelope 400 is coupled to the lamp body 200. The envelope 400 comprises a through hole 410 and a plurality of gaps 420. The through hole 410 is coupled to the tube 230. Each gap 420 is coupled to a corresponding ridge 240. The envelope 400 can be transparent or semitransparent. The envelope 400 can be made of glass or plastic. In this embodiment, each ridge 240 also comprises an edge 245. Each edge 245 comprises one first part 2451 and two second parts 2452. The first part 2451 is extended along a direction from the first wall 241 of the ridge 240 to the envelope 400. The first part 2451 is perpendicular to the first wall 241 of the ridge 240. The second part 2452 is extended from the third wall 243. The second part 2452 is coplanar with the third wall 243. Each gap 420 is connected to the first part 2451 and the second part 2452 of each ridge 240.

It is to be further understood that even though numerous characteristics and advantages have been set forth in the foregoing description of embodiments, together with details of the structures and functions of the embodiments, the disclosure is illustrative only; and that changes may be made in detail, according in matters of shape, size, and arrangement of parts within the principles of the disclosure to the full extent indicated by the broad general meaning of the terms in which the appended claims are expressed.

The embodiments shown and described above are only examples. Many details are often found in the art such as the other features of an LED lamp. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. An LED lamp comprising:

a light source;

a lamp holder;

a lamp body connected between the light source and the lamp holder, wherein the lamp body comprises a hollow main body, a plurality of fins, a cup, a tube and a plurality of ridges, the hollow main body is connected to the lamp holder, the fins are connected between the hollow main body and the cup, a plurality of channels are defined between the fins, a hole is defined in the cup, the tube is connected to the hole of the cup, the ridges are formed on the cup and around the tube, the light source is formed on the ridges, the light source comprises a plurality of LED elements and a plurality of circuit printed boards; and an envelope comprising a through hole coupled to the hole of the tube and a plurality of gaps coupled to the ridges;

wherein the hollow main body is a hollow cylinder.

2. The LED lamp of claim 1, wherein each ridge further comprises an edge, the edge comprises one first part and two second part, the first part is extended along a direction from the first wall of the ridge to the envelope, the first part is perpendicular to the first wall of the ridge, the second part is extended from the third wall, the second part is coplanar with the third wall.

3. The LED lamp of claim 1, wherein the hollow main body comprises a first opening and a second opening, and the first opening faces the cup.

4. The LED lamp of claim 3, wherein a chamber is defined in the hollow main body, and the chamber is connected between the first opening and the second opening.

5. The LED lamp of claim 4, wherein the fins are extended beyond the first opening of the hollow main body, a space is defined between the cup and hollow main body, and the space is connected between the chamber, the channels defined between the fins and the hole of the cup.

6. The LED lamp of claim 3, wherein the fins are connected between a periphery of the hollow main body and an inside surface of the cup.

7. The LED lamp of claim 6, wherein the fins are formed in vicinity of the first opening of the hollow main body.

8. The LED lamp of claim 7, wherein each fin is extended beyond the first opening of the hollow main body, a space is defined between the cup and the first opening of the hollow main body.

9. The LED lamp of claim 1, wherein a first end and a second end are defined in the cup, and a diameter of the second end is larger than that of the first end.

10. The LED lamp of claim 9, wherein the hole of the cup is defined in the first end, an orifice is defined in the second end the cup covers the fins, and the orifice faces the hollow main body.

11. The LED lamp of claim 10, wherein a diameter of the orifice is larger than that of the hole.

12. The LED lamp of claim 1, wherein each ridge comprises a first wall, a second wall opposite to the first wall, and two third walls opposite to each other, the two third walls are connected between the first wall and the second wall, the first wall is extended from an outside surface of the tube, the second wall is defined as a sunken area of the cup, the second wall is sunken from the cup to hollow main body, the two third wall are extend from the first wall along a direction from the tube to the second wall.

13. The LED lamp of claim 12, wherein the number of the ridges is three, the three ridges are extended from the outside surface of the tube, and an angle between each two adjacent ridges is 120°.

14. The LED lamp of claim 12, wherein the first wall and the two third walls compose a U-shaped structure with a groove defined away from the tube.

15. The LED lamp of claim 14, wherein each circuit printed board is a U-shaped, and each circuit printed board spans over and fittingly engages with one ridge.

16. An LED lamp comprising:

a light source comprising a plurality of light emitting diode elements and a plurality of circuit printed boards;

a lamp body that coupled between a lamp holder and the light source comprising:

a hollow main body connected to the lamp holder, a plurality of fins, each connected between the hollow main body and a cup defining a hole, a tube connected to the hole; and the cup further defining a plurality of ridges on which the light source is formed;

wherein a plurality of channels are defined between the fins;

wherein a first end and a second end are defined in the cup, and a diameter of the second end is larger than that of the first end; and wherein the hole of the cup is defined in the first end, an orifice is defined in the second end the cup covers the fins, and the orifice faces the hollow main body.

17. An LED lamp comprising:

a light source;

a lamp holder; and a lamp body connected between the light source and the lamp holder, wherein the lamp body comprises a hollow main body, a plurality of fins, a cup, a tube and a plurality of ridges, the hollow main body is connected to the lamp holder, the fins are connected between the hollow main body and the cup, a plurality of channels are defined between the fins, a hole is defined in the cup, the tube is connected to the hole of the cup, the ridges are formed on the cup and around the tube, the light source is formed on the ridges, the light source comprises a plurality of LED elements and a plurality of circuit printed boards; and wherein each ridge comprises a first wall, a second wall opposite to the first wall, and two third walls opposite to each other, the two third walls are connected between the first wall and the second wall, the first wall is extended from an outside surface of the tube, the second wall is defined as a sunken area of the cup, the second wall is sunken from the cup to hollow main body, the two third wall are extend from the first wall along a direction from the tube to the second wall.

* * * * *